US008362957B2

(12) United States Patent
Lehtola et al.

(10) Patent No.: US 8,362,957 B2
(45) Date of Patent: Jan. 29, 2013

(54) RADIATION PATTERN CONTROL

(75) Inventors: Antero Lehtola, Turku (FI); Aimo Arkko, Ruutana (FI)

(73) Assignee: Nokia Corporation, Espoo (FI)

( * ) Notice: Subject to any disclaimer, the term of this patent is extended or adjusted under 35 U.S.C. 154(b) by 519 days.

(21) Appl. No.: 12/449,631

(22) PCT Filed: Feb. 28, 2007

(86) PCT No.: PCT/IB2007/001678

§ 371 (c)(1),
(2), (4) Date: Aug. 18, 2009

(87) PCT Pub. No.: WO2008/104826

PCT Pub. Date: Sep. 4, 2008

(65) Prior Publication Data

US 2010/0315293 A1 Dec. 16, 2010

(51) Int. Cl.
*H01Q 1/38* (2006.01)

(52) U.S. Cl. ..... 343/700 MS; 343/702

(58) Field of Classification Search ..... 343/700 MS, 343/829, 846, 847, 702
See application file for complete search history.

(56) References Cited

U.S. PATENT DOCUMENTS

| | | | | |
|---|---|---|---|---|
| 5,631,659 | A * | 5/1997 | Evans et al. | 343/700 MS |
| 7,983,721 | B2 * | 7/2011 | Ying et al. | 455/575.1 |
| 2004/0037052 | A1 | 2/2004 | Wu et al. | 361/752 |
| 2004/0046701 | A1 | 3/2004 | Huber et al. | 343/702 |
| 2005/0285798 | A1 | 12/2005 | van Wonterghem et al. | 343/702 |
| 2006/0082514 | A1 | 4/2006 | Chiang et al. | 343/794 |
| 2006/0181468 | A1 | 8/2006 | Iguchi et al. | 343/702 |
| 2009/0213026 | A1 * | 8/2009 | Lindberg et al. | 343/848 |

FOREIGN PATENT DOCUMENTS

| | | | |
|---|---|---|---|
| EP | 1583172 | A2 | 10/2005 |
| EP | 1626457 | A1 | 2/2006 |
| EP | 1638165 | A1 | 3/2006 |
| EP | 1755190 | A1 | 2/2007 |
| SE | 528327 | C2 | 10/2006 |
| WO | WO 2004/084344 | A1 | 9/2004 |
| WO | WO-2007004499 | A1 | 1/2007 |
| WO | WO-2007043941 | A1 | 4/2007 |

* cited by examiner

*Primary Examiner* — Dieu H Duong
(74) *Attorney, Agent, or Firm* — Harrington & Smith

(57) ABSTRACT

An apparatus including: a first antenna element; a second antenna element; a ground plane element for at least one of the first and second antenna elements; a first choke arranged to affect a first maximum of current density produced in the ground plane element by the first antenna element; and a second choke arranged to affect a second maximum of current density produced in the ground plane element by the second antenna element.

30 Claims, 1 Drawing Sheet

RADIATION PATTERN CONTROL

FIELD OF THE INVENTION

Embodiments of the present invention relate to radiation pattern control.

BACKGROUND TO THE INVENTION

A radio transmission apparatus radiates radio frequency (RF) electromagnetic energy in a radiation pattern. The radio transmission apparatus typically has at least one antenna element that is used to control the characteristics of the radiation pattern such as its shape at one or more particular RF frequencies.

The radiation pattern is dependent upon the RF electric currents in the radio transmission apparatus. RF electric currents are driven in the antenna element and may also exist in other conductive elements within the radio transmission apparatus such as a ground plane.

It is often desirable to control the shape of a radiation pattern so that the radio transmission apparatus radiates more strongly in a first direction than a second direction. This control improves the efficiency of the radio transmission apparatus in the first direction at the expense of efficiency in the second direction.

It would be desirable to control electric currents that exist within a conductive element, particularly a ground plane, and thereby control the radiation pattern of the radio transmission apparatus.

BRIEF DESCRIPTION OF THE INVENTION

According to some embodiments of the invention there is provided an apparatus comprising: a first antenna element; a second antenna element; a ground plane element coupled to at least one of the first and second antenna elements; a first choke arranged to affect a first maximum of current density produced in the ground plane element by the first antenna element; and a second choke arranged to affect a second maximum of current density produced in the ground plane element by the second antenna element.

The first choke affects the first maximum of current density by suppressing the intensity of the first maximum of the current density. The second choke affects the second maximum of current density by suppressing the intensity of the second maximum of the current density. Suppression of a maximum in current density may result in changing the location of a maximum of the current density.

According to some embodiments of the invention there is provided an apparatus comprising: a first antenna element; a second antenna element; a conductive element having a first region and a second region; a first transmission line comprising a first end having a low impedance load and a second end positioned adjacent the first region; and a second transmission line comprising a first end having a low impedance load and a second end positioned adjacent the second region.

According to some embodiments of the invention there is provided a method comprising: suppressing electric current, at a resonant frequency of a first antenna element, at a first region of an apparatus, wherein the apparatus comprises the first antenna element and a second antenna element; and suppressing electric current, at a resonant frequency of the second antenna element, at a second, different, region of the apparatus.

BRIEF DESCRIPTION OF THE DRAWINGS

For a better understanding of the present invention reference will now be made by way of example only to the accompanying drawings in which.

DETAILED DESCRIPTION OF EMBODIMENTS OF THE INVENTION

Figure 1:
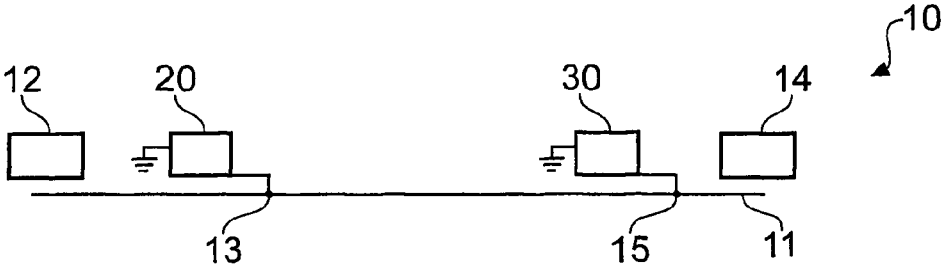
FIG. 1 schematically illustrates one embodiment of a radio transmission apparatus.

FIG. 1 schematically illustrates an apparatus 10 comprising a first antenna element 12, a second antenna element 14, a ground plane element 11, a first choke 20 and a second choke 30. The apparatus 10 is capable of transmitting RF radio waves. It may also be capable of receiving RF radio waves.

One or both of the first antenna element 12 and the second antenna element 14 use the conductor 11 as a ground plane.

The first antenna element 12 has a resonant frequency f1 that has a corresponding resonant wavelength $\lambda$1. In use the first antenna element 12 creates a high electric current density at a first region 13 of the ground plane 11.

The first choke 20 suppresses large electric current densities at the first region 13. This reduces the electric current density at the first region 13. The first choke 20 is a frequency-dependent impedance that has a low input impedance at the resonant frequency f1.

The second antenna element 14 has a resonant frequency f2 that has a corresponding resonant wavelength $\lambda$2. In use the second antenna element 14 creates a high electric current density at a second region 15 of the ground plane 11.

The second choke 30 suppresses large electric current densities at the second region 15. This reduces the electric current density at the second region 15. The second choke 20 is a frequency dependent impedance that has a low input impedance at the resonant frequency f2.

The presence and positioning of the first and second chokes modifies the distribution of electric currents in the ground plane 11 and reduces the maximum current densities at the regions 13 and 15.

Figure 2:
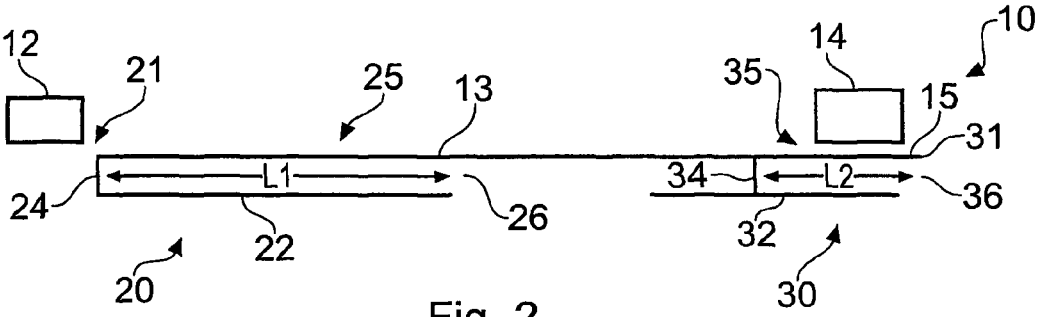
FIG. 2 schematically illustrates another embodiment of a radio transmission apparatus.

FIG. 2 schematically illustrates an embodiment of the apparatus 10 and like reference numerals refer to like elements. The apparatus may be, for example, a radio communication device or a module for a radio communication device.

The first choke 20 comprises a quarter wavelength transmission line 25 formed by the combination of the ground plane 11 and a first conductor 22. The first conductor 22 runs parallel to the ground plane 11. The parallel combination of the first conductor 22 and the ground plane 11 forms a transmission line 25 that has a first end 24 and a second end 26. The second end 26 is positioned adjacent the first region 13 of the ground plane 11 and the first end 24 is positioned a distance L1 away where L1=$\lambda$1/4. In this example, the first end is positioned at an extremity 21 of the ground plane 11 adjacent the first antenna element 12 and the second end 26 is positioned towards the center of the ground plane 11.

The first end 24 of the transmission line 25 has a low impedance load formed by the galvanic connection of the first conductor 22 to the ground plane 11. This low impedance load forces the ground plane currents to have current maximum at this connection point. The (electrical) length L1 of the transmission line i.e. the distance between the first end 24 and the second end 26 corresponds to λ1/4, The input impedance to the transmission line 25 at the second end 26 is selectively high at the resonant frequency f1 of the first antenna element 12 and the input impedance to the transmission line 25 at the first end 24 is low. The transmission line 25 relocates the maximum in the current density from the first region 13 of the ground plane 11. The current density at the first region 13 is therefore reduced.

The second choke 30 comprises a quarter wavelength transmission line 35 formed by the combination of the ground plane 11 and a second conductor 32. The second conductor 32 runs parallel to the ground plane 11. The parallel combination of the second conductor-32 and the ground plane 11 forms a transmission line that has a first end 34 and a second end 36. The second end 36 is positioned adjacent the second region 15 of the ground plane 11 and the first end 34 is positioned a distance L2 away where L2=λ2/4. In this example, the second end 36 is positioned at an extremity 31 of the ground plane 11 adjacent the second antenna element 14 and the first end 34 is positioned towards the center of the ground plane 11.

The first end 34 of the transmission line 30 has a low impedance load formed by the galvanic connection of the second conductor 32 to the ground plane 11. This low impedance load forces the ground plane currents to have current maximum at this connection point.

The input impedance to the transmission line 35 at the second end 36 is selectively high at the resonant frequency f2 of the second antenna element 14 and the input impedance to the transmission line 35 at the first end 34 is low. The transmission line 35 relocates the maximum in the current density from the second region 15 of the ground plane 11. The current density at the second region 15 is therefore reduced.

It will be appreciated that for a particular transmission line, the open or floating second end 36 should be positioned adjacent to a region of maximum current density created by an antenna element and the electrical length of the transmission line should be a quarter wavelength (at the resonant frequency of the antenna element). The position of the closed first end may be positioned to accommodate these constraints.

In the illustrated embodiment, the first antenna element 12 is an off ground antenna element. That is, it is positioned so that it does not overlie the ground plane 11. The first antenna element 12 may be for example, an internal monopole. The second antenna element 14 is an on ground antenna element. That is, it is positioned so that it overlies the ground plane 11. The second antenna element 14 may be, for example, a planar inverted antenna such as a planar inverted F antenna (PIFA) or a planar inverted L antenna (PILA). It should, however, be appreciated that different positioning and types of antenna elements may be used.

In this implementation, the first antenna element 12 is a low band antenna element and the second antenna element 14 is a high band antenna element. However, in other implementations the second antenna element 14 could be a low band antenna element and the first antenna element 12 could be a high band antenna element.

The low and high bands may be any transmitting bands of the following bands so long as the high band is at a higher frequency that the lower band: AM radio (0.535-1.705 MHz); FM radio (76-108 MHz); Bluetooth (2400-2483.5 MHz); WLAN (2400-2483.5 MHz); HLAN (5150-5850 MHz); GPS (1570.42-1580.42 MHz); US-GSM 850 (824-894 MHz); EGSM 900 (880-960 MHz); EU-WCDMA 900 (880-960 MHz); PCN/DCS 1800 (1710-1880 MHz); US-WCDMA 1900 (1850-1990 MHz); WCDMA 2100 (Tx: 1920-1980 MHz Rx: 2110-2180 MHz); PCS1900 (1850-1990 MHz); UWB Lower (3100-4900 MHz); UWB Upper (6000-10600 MHz); DVB-H (470-702 MHz); DVB-H US (1670-1675 MHz); DRM (0.15-30 MHz); Wi Max (2300-2400 MHz, 2305-2360 MHz, 2496-2690 MHz, 3300-3400 MHz, 3400-3800 MHz, 5250-5875 MHz); DAB (174.928-239.2 MHz, 1452.96-1490.62 MHz); RFID LF (0.125-0.134 MHz); RFID HF (13.56-13.56 MHz); RFID UHF (433 MHz, 865-956 MHz, 2450 MHz).

Figure 3:
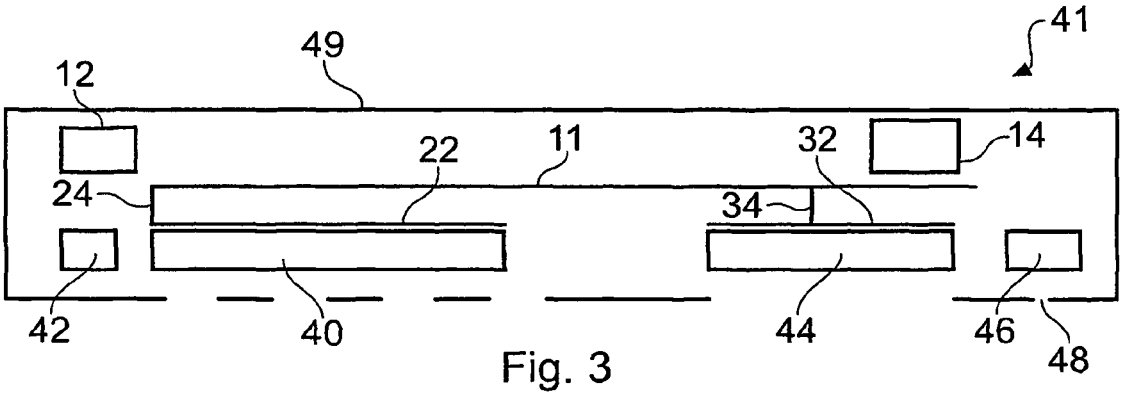
FIG. 3 schematically illustrates a mobile cellular telephone.

FIG. 3 schematically illustrates a radio communication device mobile cellular telephone 41 that comprises the apparatus 10 illustrated in FIG. 2. In addition, the mobile telephone 41 comprises a housing 49, a keypad 40, a microphone 42, a display 44 and a loudspeaker 46. There is also a loudspeaker port 48 in the housing 49 adjacent the loudspeaker 46.

Although in the Figure, the loudspeaker 48 and the second antenna element 14 are illustrated as separate components, this is only for clarity of illustration. The loudspeaker 48 may be an integral part of the second antenna element 14.

The display 44, in this example, has a metal shield that provides the second conductor 32.

The keypad 40 has, in this example, a printed wiring board (PWB) that provides the first conductor 22.

In this implementation, the first antenna element 12 is a low band antenna element and the second antenna element 14 is a high band antenna element. However, in other implementations the second antenna element 14 could be a low band antenna element and the first antenna element 12 could be a high band antenna element.

As an example, the low band may correspond to EGSM and/or US-GSM and the high band may correspond to PCN/DCS and/or PCS1900 or US-WCDMA and/or WCDMA2100 and/or WLAN or Bluetooth.

The first antenna element 12 on the second antenna element 14 may be separated by almost the full length of the mobile telephone 41. In this example the PWB of the mobile telephone 41 is used as the ground plane 11. The antenna element at the top of the phone, adjacent the loudspeaker port 48, is typically an on ground antenna element i.e. it overlies the ground plane 11.

In other implementations the first antenna element 12 could also be on the same end of the ground plane as the second antenna element 14. In this position the first antenna element 12 would similarly create a high electric current density at a first region 13 of the ground plane 11 if current densities at a first region 13 are due to the ground plane resonance currents and then the position of this high current density region 13 does not depend on where the first antenna element 12 is positioned on the ground plane 11. Thus in this case the first choke 20 would similarly suppress the large electric current densities at the first region 13 of the ground plane 11.

Figure 4:
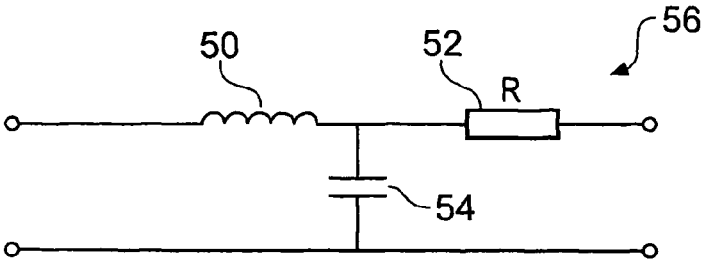
FIG. 4 schematically illustrates an equivalent circuit for a transmission line.

FIG. 4 schematically illustrates an equivalent circuit 56 for a transmission line. The equivalent circuit 56 comprises an inductance 50, a resistance 52 and a capacitance 54. Additionally, a shunt resistor (not illustrated) may complete the equivalent circuit of a transmission line, which represents conductance. Although these impedances are illustrated as lumped components, in a transmission line they are typically wholly or partially distributed.

In the above described embodiment of FIG. 2, it has been described that the length L1 is dependent upon the resonant frequency of the first antenna element and that the length L2 is dependent upon the resonant frequency of the second antenna element 14. However, the physical length of the transmission lines may be reduced by using dielectric material in the gap between the conductive element and the ground plane.

In some embodiments the transmission lines may be augmented with lumped impedances. Such lumped components could be used to reduce the physical length of a transmission line while maintaining its effective electrical length.

In some embodiments the transmission lines may be replaced with lumped impedances.

Although embodiments of the present invention have been described in the preceding paragraphs with reference to various examples, it should be appreciated that modifications to the examples given can be made without departing from the scope of the invention as claimed.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

We claim:

1. An apparatus comprising:

a first antenna element;

a second antenna element;

a ground plane element coupled to at least one of the first and second antenna elements;

a first transmission line, formed by a first conductor and the ground plane element, arranged to affect a first maximum of current density produced in the ground plane element by the first antenna element;

wherein the first transmission line is terminated at a first end by a low impedance load and is terminated by a high impedance load at a second end; and a second transmission line arranged to affect a second maximum of current density produced in the ground plane element by the second antenna element;

wherein the first end of the first transmission line is closer to the first antenna element than the second end of the first transmission line, and wherein the second end of the first transmission line is positioned adjacent the region of maximum current density produced in the ground plane element by the first antenna element.

2. The apparatus as claimed in claim 1, wherein the low impedance load is a galvanic short-circuit connection between the first conductor and the ground plane.

3. The apparatus as claimed in claim 2, wherein the high impedance load is an open circuit gap between the first conductor and the ground plane.

4. The apparatus as claimed in claim 1, wherein the first end of the first transmission line is positioned to achieve a desired position for the second end of the first transmission line and a desired length for the first transmission line.

5. The apparatus as claimed in claim 1, wherein the first antenna element has a first resonant frequency that has a corresponding first resonant wavelength and the first transmission line has a length equivalent to one quarter of the first resonant wavelength.

6. The apparatus as claimed in claim 1, wherein the second transmission line is formed by a second conductor and the ground plane.

7. The apparatus as claimed in claim 6, wherein the second transmission line is terminated at a first end by a second low impedance load and a second high impedance load at a second end.

8. The apparatus as claimed in claim 7, wherein the second low impedance load is a short-circuit connection between the second conductor and the ground plane.

9. The apparatus as claimed in claim 7, wherein the second end of the second transmission line is positioned adjacent a region of maximum current density produced in the ground plane element by the second antenna element.

10. The apparatus as claimed in claim 7, wherein the first end of the second transmission line is positioned to achieve a desired position for the second end of the second transmission line and a desired length for the second transmission line.

11. The apparatus as claimed in claim 7, wherein the second high impedance load is an open circuit gap between the second conductor and the ground plane.

12. The apparatus as claimed in claim 6, wherein the second antenna element has a second resonant frequency that has a corresponding second resonant-wavelength and the second transmission line has a length equivalent to one quarter of the second resonant wavelength.

13. The apparatus as claimed in claim 1, wherein the first antenna element operates at a lower frequency than the second antenna element and the first antenna element and the second antenna element are positioned at opposite extremities of the ground plane.

14. The apparatus as claimed in claim 1, wherein the first transmission line is formed by a portion of a keypad and the ground plane.

15. The apparatus as claimed in claim 1, wherein the second transmission line is formed by a portion of a display and the ground plane.

16. The apparatus as claimed in claim 1, wherein the second antenna element is positioned over the ground plane and adjacent a loudspeaker port.

17. The apparatus as claimed in claim 1, wherein the second antenna element is part of a planar inverted antenna.

18. The apparatus as claimed in claim 1, wherein the ground plane element is a PWB.

19. The apparatus as claimed in claim 1 configured as a module for a radio communications device.

20. The apparatus as claimed in claim 1 configured as a radio communications device.

21. An apparatus comprising:

a first antenna element;

a second antenna element;

a conductive element having a first region and a second region;

a first transmission line formed by a first conductor and the conductive element, arranged to affect a first maximum of current density produced at the first region of the conductive element by the first antenna element; the first transmission line comprising a first end having a low impedance load and a second end having a high impedance load; and a second transmission line, arranged to affect a second maximum of current density produced at the second region of the conductive element by the second antenna element;

wherein the first end of the first transmission line is closer to the first antenna element than the second end of the first transmission line; and wherein the second end of the first transmission line is positioned adjacent the region of maximum current density produced at the first region of the conductive element by the first antenna element.

22. The apparatus as claimed in claim 21, wherein the first antenna element has a first resonant frequency that has a corresponding first resonant wavelength and the first transmission line has an electrical length that is a quarter of the first resonant wavelength and the second antenna element has a second resonant frequency that has a corresponding second resonant wavelength and the second transmission line has an electrical length that is a quarter of the second resonant wavelength.

23. The apparatus as claimed in claim 22, wherein the first resonant wavelength is greater than the second resonant wavelength and the second end of the first transmission line is a first distance from the first antenna element and a second end of the second transmission line, adjacent the second region, is a second distance from the second antenna element, wherein the first distance is greater than the second distance.

24. A method comprising:

Suppressing, using a first transmission line comprising a first end having a first low impedance load and a second end, electric current, at a resonant frequency of a first antenna element, at a first region of an apparatus, wherein the apparatus comprises the first antenna element and a second antenna element; and suppressing electric current, at a resonant frequency of the second antenna element, at a second, different, region of the apparatus;

wherein the first end of the first transmission line is closer to the first antenna element than the second end of the first transmission line; and wherein the second end of the first transmission line is positioned adjacent a region of maximum current density produced in a ground plane element by the first antenna element.

25. The method as claimed in claim 24 further comprising: using a second transmission line to suppress electric current at the resonant frequency of the second antenna element at the second region.

26. The method as claimed in claim 25, wherein the second transmission line is formed by a second conductor and the ground plane.

27. The method as claimed in claim 26, wherein the second antenna element has a second resonant frequency that has a corresponding second resonant wavelength and the second transmission line has a length equivalent to one quarter of the second resonant wavelength.

28. The method as claimed in claim 24, wherein the first transmission lines is formed by a first conductor and the ground plate element.

29. The method as claimed in claim 28, wherein the first antenna element has a first resonant frequency that has a corresponding first resonant wavelength and the first transmission line has a length equivalent to one quarter of the first resonant wavelength.

30. An apparatus comprising:

a first antenna element;

a second antenna element;

a ground plane element for at least one of the first and second antenna elements;

a first transmission line formed by a first conductor and the ground plane element arranged to affect a first maximum of current density produced in the ground plane element by the first antenna element;

wherein the first transmission line is terminated at a first end by a low impedance load and is terminated by a high impedance load at a second end; and means for affecting a second maximum of current density produced in the ground plane element by the second antenna element;

wherein the first end of the first transmission line is closer to the first antenna element than the second end of the first transmission line; and wherein the second end of the first transmission line is positioned adjacent the region of maximum current density produced in the ground plane element by the first antenna element.

* * * * *

UNITED STATES PATENT AND TRADEMARK OFFICE

CERTIFICATE OF CORRECTION

PATENT NO. : 8,362,957 B2
APPLICATION NO. : 12/449631
DATED : January 29, 2013
INVENTOR(S) : Antero Lehtola and Aimo Arkko It is certified that error appears in the above-identified patent and that said Letters Patent is hereby corrected as shown below:

In the Claims:

In column 8, line 8, "plate" should be deleted and -- plane -- should be inserted.

Signed and Sealed this
Seventh Day of May, 2013

Teresa Stanek Rea
*Acting Director of the United States Patent and Trademark Office*